US006514384B1

(12) United States Patent
Jewell et al.

(10) Patent No.: US 6,514,384 B1
(45) Date of Patent: Feb. 4, 2003

(54) METHOD FOR INCREASING FILLER RETENTION OF CELLULOSIC FIBER SHEETS

(75) Inventors: Richard A. Jewell, Bellevue, WA (US); Amar N. Neogi, Seattle, WA (US); Steven J. White, Gig Harbor, WA (US)

(73) Assignee: Weyerhaeuser Company, Federal Way, WA (US)

( * ) Notice: Subject to any disclaimer, the term of this patent is extended or adjusted under 35 U.S.C. 154(b) by 0 days.

(21) Appl. No.: 09/272,865

(22) Filed: Mar. 19, 1999

(51) Int. Cl.[7] ..... D21H 11/20

(52) U.S. Cl. ..... 162/181.1; 162/9; 162/182; 162/183; 162/157.6

(58) Field of Search ..... 162/111, 181.1, 162/189, 9, 156.6, 146, 164.3, 164.6

(56) References Cited

U.S. PATENT DOCUMENTS

| | | | | | |
|---|---|---|---|---|---|
| 4,610,801 | A | * | 9/1986 | Matthews et al. | 162/181.2 |
| 5,147,507 | A | * | 9/1992 | Gill | 162/181.2 |
| 5,201,998 | A | | 4/1993 | Töpfl et al. | |
| 5,244,542 | A | * | 9/1993 | Bown et al. | 162/181.2 |
| 5,514,249 | A | | 5/1996 | Cauley et al. | |
| 5,522,967 | A | * | 6/1996 | Shet | 162/9 |
| 5,543,014 | A | | 8/1996 | Rushmere et al. | |
| 5,611,890 | A | * | 3/1997 | Vinson et al. | 162/181.1 |
| 5,667,637 | A | | 9/1997 | Jewell et al. | |
| 5,755,828 | A | | 5/1998 | Westland | |
| 5,755,930 | A | * | 5/1998 | Satterfield | 162/181.2 |
| 5,827,398 | A | * | 10/1998 | Depasquale et al. | 162/181.2 |
| 5,935,383 | A | | 8/1999 | Sun et al. | |
| 5,958,180 | A | * | 9/1999 | Hubbe et al. | 162/9 |

FOREIGN PATENT DOCUMENTS

| | | |
|---|---|---|
| EP | 0 373 306 A2 | 6/1990 |
| EP | 0 499 448 A1 | 8/1992 |
| WO | WO 93/01353 | 1/1993 |
| WO | WO 95/07303 | 3/1995 |
| WO | WO 98/24974 | 6/1998 |

OTHER PUBLICATIONS

Shet, R. T., et al., "Crease–Recovery and Tensile–Strength Properties of Unmodified and Modified Cotton Cellulose Treated with Crosslinking Agents," *Textile Research Journal,* Nov. 1981, pp. 740–744.

Luner, P., et al., "The Effect of Chemical Modification on The Mechanical Properties of Paper II. Wet Strength of Oxidized Springwood and Summerwood Southern Pine Kraft Fibers," *TAPPI,* vol. 50, No. 3, Mar. 1967, pp. 117–120.

Luner, P., et al., "The Effect of Chemical Modification on The Mechanical Properties of Paper 3. Dry Strength of Oxidized Springwood and Summerwood Southern Pine Kraft Fibers," *TAPPI,* vol. 50, No. 5, May 1967, pp. 227–230.

Fukatsu, K., "Dyeing and Mechanical Properties of Cotton Modified for Cationic Dyes with Hydrophobic and Acidic Groups," *Textile Research Journal,* Mar. 1992, pp. 135–139.

Datye, K. V., et al., "Studies in the Reaction of Formaldehyde with Unmodified, Modified, and Dyed Celluloses Part III: The Reaction of Formaldehyde with Oxycelluloses," *Textile Research Journal,* Jul. 1963, pp. 500–510.

Young, R.A., "Bonding of Oxidized Cellulose Fibers and Interaction with Wet Strength Agents," *Wood and Fiber,* vol. 10(2), Summer 1978, pp. 112–119.

Andersson, R., et al., Note: "An N.M.R. Study of the Products of Oxidation of Cellulose and (1→4)–β–D–xylan with Sodium Nitrite in Orthophosphoric Acid," *Carbohydrate Research ,* vol. 206, 1990, pp. 340–346.

Shenai, V.A., et al., "Hypochlorite Oxidation of Cellulose in the Presenc of Cobalt Sulphide," *Textile Dyer & Printer,* vol. 20, May 20, 1987, pp. 17–22.

Isogai, A., et al., "Preparation of Polyuronic Acid From Cellulose by TEMPO–Mediated Oxidation," *Cellulose,* vol. 5, 1998, pp. 153–164.

Heinze, T.J., et al., Eds., CELLULOSE DERIVATIVES—MODIFICATION, CHARACTERIZATION, AND NANOSTRUCTURES, Besemer, A.C., et al., Chapter 5, "Methods for the Selective Oxidation of Cellulose: Preparation of 2,3–Dicarboxycellulose and 6–Carboxycellulose," *Journal of the American Chemical Society,* 212th National Meeting of the American Chemical Society, Aug. 25–29, 1996, pp. 73–82.

* cited by examiner

*Primary Examiner*—Peter Chin
(74) *Attorney, Agent, or Firm*—Christensen O'Connor Johnson Kindness PLLC

(57) ABSTRACT

A method for increasing filler retention of cellulosic fiber sheets is disclosed. In the method, cellulosic fibers with increased anionic sites are treated with either positively charged filler particles and/or amphoteric filler particles or a cationic retention aid and negatively charged filler particles and/or amphoteric filler particles. Cellulosic fiber sheets with retained filler particles are also disclosed.

23 Claims, 7 Drawing Sheets

METHOD FOR INCREASING FILLER RETENTION OF CELLULOSIC FIBER SHEETS

FIELD OF THE INVENTION

The present invention relates to a method for increasing filler retention of cellulosic fiber sheets and, more particularly, to a method for increasing filler retention for cellulosic fiber sheets by incorporating cellulosic fibers having increased anionic sites into the sheet.

BACKGROUND OF THE INVENTION

Fillers are often incorporated into cellulosic fiber sheets to provide paper products having enhanced printability and improved optical properties. However, the improvement provided by filler is limited by the amount of filler that can be retained by the fiber sheet. Accordingly, there exist a need for methods for increasing fiber capacity for filler and for increasing the filler retention of fiber sheets. The present invention seeks to fulfill these needs and provides further related advantages.

SUMMARY OF THE INVENTION

In one aspect, the present invention provides a method for increasing filler retention of cellulosic fiber sheets. In the method, cellulosic fibers with increased anionic sites are treated with either positively charged and/or amphoteric filler particles or a cationic retention aid and negatively charged and/or amphoteric filler particles to provide sheets having increased filler retention.

In another aspect of the invention, cellulosic fiber sheets with retained filler particles are provided. In one embodiment, fiber sheets with retained positively charged and/or amphoteric filler particles are provided and, in another embodiment, the fiber sheets with retained negatively charged and/or amphoteric filler particles are provided.

In a further aspect, a method for increasing drainage from a papermaking furnish is provided. In the method, cellulosic fibers having increased anionic sites are incorporated into the furnish.

BRIEF DESCRIPTION OF THE DRAWINGS

The foregoing aspects and many of the attendant advantages of this invention will become more readily appreciated by reference to the following detailed description, when taken in conjunction with the accompanying drawings, wherein.

DETAILED DESCRIPTION OF THE PREFERRED EMBODIMENT

Figure 1:
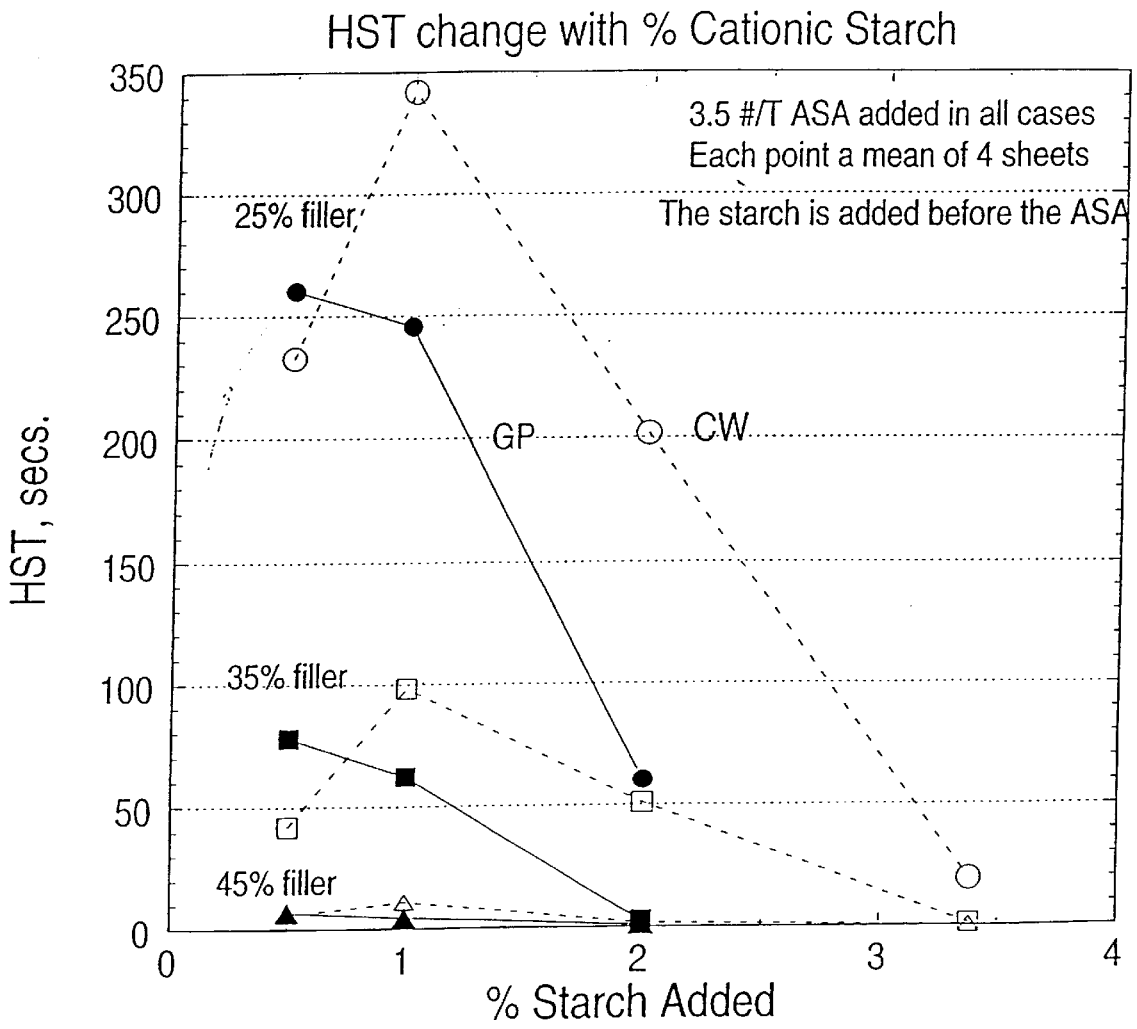
FIG. 1 is a graph illustrating the change in sizing as a function of added cationic starch for fibrous sheets formed in accordance with the present invention.

The present invention provides a method for increasing filler retention in cellulosic fiber sheets. The method provides a cellulosic fiber sheet having retained filler particles. When fibers having increased anionic sites and filler particles are incorporated into a papermaking furnish, and the furnish is deposited onto the papermachine's forming wire, the resulting furnish can be drained at an increased rate relative to comparable furnishes lacking cellulosic fibers having increased anionic sites.

As used herein, the term "filler particle" refers to positively charged filler particles, negatively charged filler particles, and amphoteric filler particles. Amphoteric particles can be either formally charged (i.e., positively or negatively charged) or lack formal charge. Filler particles useful in the present invention are retained to cellulosic fibers through electrostatic bonding and association. Filler particles are generally noncellulosic particle additives combined with cellulosic fibers in the papermaking process to provide paper products having improved properties compared to paper products containing solely cellulosic fibers.

In general, the method of the invention includes applying either (1) positively charged and/or amphoteric filler particles or (2) cationic retention aid and negatively charged and/or amphoteric filler particles to cellulosic fibers having an increased number of fixed anionic sites. The terms "cellulosic fibers having an increased number of fixed anionic sites" and "cellulosic fibers having increased anionic sites" refer to cellulosic fibers that have been modified such that the number of available anionic sites in the fibers is increased relative to corresponding fibers that have not been so modified.

By virtue of its hydroxyl groups, cellulose is a polar molecule that can form hydrogen bonds with other polar molecules, such as other cellulose molecules, to form fibers. Wood pulp fibers contain cellulose and hemicelluloses. Hemicelluloses contain a small number of carboxyl groups, providing the fibers with an overall negative charge. Accordingly, cellulose has some natural tendency to retain certain other materials. To increase cellulose's capacity to form bonds with and retention of certain materials, the method of the present invention provides for increasing the number of sites on the fiber to which bonding can occur. Accordingly, the addition of fixed anionic sites (e.g., carboxyl groups) to cellulose fibers provides the fibers with additional sites or positions through which bonding to cationic species can occur. In the practice of the invention, the number of carboxyl groups added to a fiber is not particularly critical and can be controlled to provide fibers having the desired capacity for and retention of certain materials. Generally, the greater the number of fixed anionic sites for a cellulosic fiber, the greater the filler retention of fiber sheets incorporating these fibers. In general, increasing the number of carboxyl groups for a cellulosic fiber will increase its capacity to bond to cationic materials and its ability to retain those materials. As used herein, the term "bond" refers to the electrostatic attractive force between oppositely charged materials, such as the anionic sites of a cellulose fiber and a cationic retention aid or positively charged filler particle. The term "charged" refers to materials and particles having formal positive and negative charges as well as to materials lacking formal charge but that are capable of electrostatic bonding and association through dipolar interactions.

Anionic sites can be introduced into a cellulosic fiber by, for example, chemically modifying the fiber to increase the fiber's carboxyl content. Suitable methods for increasing a fiber's carboxyl content include any method that results in carboxyl group incorporation. Preferably carboxyl group introduction into cellulosic pulp is without substantial crosslinking and without substantially reducing the degree of polymerization of the pulp. Suitable methods are known in the art and include carboxylating cellulosic fibers such as described in U.S. Pat. No. 5,667,637, issued to Jewell et al., relating to cellulose carboxyethylation; U.S. Pat. No. 5,755,828, issued to Westland, relating to polyacrylic acid carboxylation of cellulosic fibers; and U.S. patent application Ser. No. 09/222,372, filed Dec. 29, 1998, relating to cellulose succinylation; each assigned to Weyerhaeuser Co. and expressly incorporated herein by reference. Other carboxylated cellulosic fibers and methods for their formation are known and are suitable in the practice of the present invention. For example, carboxymethylated cellulose (CMC) is a suitable carboxylated cellulosic fiber. Carboxylated cellulose fibers prepared by TEMPO catalyzed oxidation of cellulose is another suitable method for increasing the number of cellulose carboxyl groups. In this method, the cellulose carboxyl groups formed are glucuronic acid groups. These fibers and methods for their formation are described in U.S. patent application Ser. No. 09/272,137, entitled "Method of Making Carboxylated Cellulose Fibers and Products of the Method," filed Mar. 19, 1999, and assigned to Weyerhaeuser Company, expressly incorporated herein by reference.

To prepare a product that includes a cationic filler particle from cellulosic fibers that have been modified to include an increased number of fixed anionic sites (e.g., a carboxylated fiber), the fiber having increased anionic sites is treated with a positively charged filler particle. For example, fibers with increased anionic sites can be combined with positively charged filler particles in an aqueous slurry and then deposited onto a foraminous support to form a wet composite. Once deposited, drainage of the slurry's dispersion medium from the wet composite occurs and, on subsequent drying, a sheet composed of cellulosic fibers with retained positively charged filler particles is produced. Alternatively, a mixture comprising a cationic filler and an anionic retention aid can be prepared and then added to a mixture of cellulosic fibers and a cationic retention aid. For example, a positively charged filler such as cationic calcium carbonate (PCC) can be mixed with anionic polyacrylamide (i.e., anionic retention aid) and then added to a mixture of cellulosic fibers and a cationic retention aid (e.g., cationic starch).

Positively charged filler particles useful in the present invention include calcium carbonate, such as chalk and precipitated calcium carbonate (PCC); and aluminum trihydrate. Precipitated calcium carbonate is a preferred positively charged filler particle.

Because cellulosic fibers modified to have increased anionic sites are anionic in nature, negatively charged filler particles cannot be directly combined with such fibers to provide fibers having retained negatively charged filler particles. In the method of the invention, negatively charged filler particles are bonded to cellulosic fibers having increased anionic sites through an intermediate cationic retention aid. The cationic retention aid serves to bond to the cellulosic fibers through its anionic sites to provide fibers effectively having a cationic surface. Through the retention aid, negatively charged filler particles are bonded to the fibers' cationic surface to provide cellulosic fibers with retained negatively charged filler particles.

Cellulosic fiber sheets with retained negatively charged filler particles can be formed sequentially by first treating fibers having increased anionic sites with a cationic retention aid and then treating the resulting fibers with negatively charged filler particles. For example, the cationic retention aid can be combined with the anionic cellulosic fibers in an aqueous slurry. To the resulting slurry are added negatively charged filler particles. However, the presence of excessive amounts of cationic retention aid can render both the filler and fiber cationic, thereby reducing filler retention. The slurry can then be then deposited on a foraminous support and the wet composite dried to provide a sheet composed of cellulosic fibers having retained negatively charged filler particles. Alternatively, a mixture of cationic retention aid and negatively charged filler particles can be added to fibers having increased anionic sites.

Cationic retention aids useful in the present invention include resins such as polyamide epichlorohydrin (commercially available under the tradename KYMENE from Hercules, Inc., Wilmington, Del., e.g., KYMENE 557H), polyethyleneimine, and polyacrylamide (commercially available under the tradename PAREZ from American Cyanamid Co., Stanford, Conn., e.g., PAREZ 631 NC and PAREZ 750B; CYPRO 514 and ACCOSTRENGTH 711 from American Cyanamid Co., Wayne, N.J.); cationic urea formaldehyde and melamine formaldehyde resins; cationic starch (commercially available under the designation WESCAT EF cationic starch from Western Polymer Co., Moses Lake, Wash.); cationic dialdehyde starch-based resin (commercially available under the designation CALDAS from Japan Carlet; National Starch 78-0080; COBOND 1000 from National Starch and Chemical Corp., New York, N.Y.). Other useful retention aids include cationic polymers such as chitosan and cationic siloxanes. Preferred cationic retention aids include cationic polyacrylamide and cationic starches.

Negatively charged filler particles useful in the present invention include ground limestone or marble (calcium carbonate, supplied in strongly anionic form due to polyanionic dispersants), clay (mildly anionic), titanium dioxide (supplied with anionic dispersant), silicas, sodium aluminosilicates, and calcinated clay. Preferred negatively charged filler particles include clay and ground limestone particles.

Cellulosic fibers are the basic component of the product of the present invention. Suitable fibers include any cellulosic fiber that can be modified to increase the fibers' fixed anionic sites. Suitable fibers include cellulosic fibers that can be modified to include carboxyl groups. Although available from other sources, cellulosic fibers are derived primarily from wood pulp. Suitable wood pulp fibers for use with the invention can be obtained from well-known chemical processes such as the Kraft and sulfite processes, with or without subsequent bleaching. The pulp fibers may also be processed by thermomechanical, chemithermomechanical methods, or combinations thereof. The preferred pulp fiber is produced by chemical methods. Ground wood fibers, recycled or secondary wood pulp fibers, and bleached and unbleached wood pulp fibers can be used. The preferred starting material is prepared from long fiber coniferous wood species, such as southern pine, Douglas fir, spruce, and hemlock. Details of the production of wood pulp fibers are well-known to those skilled in the art. These fibers are commercially available from a number of companies, including Weyerhaeuser Company. For example, suitable cellulose fibers produced from southern pine that are usable with the present invention are available from Weyerhaeuser Company under the designations CF416, NF405, PL416, FR516, and NB416. Other suitable cellulose fibers can be obtained from northern softwood bleached kraft including Grand Prairie softwood and Prince Albert NBK; Douglas fir bleached kraft including Kamloops kraft; hardwood bleached kraft and sulfite pulps; and softwood bleached sulfite pulps. Other preferred pulps include bleached hardwood chemical pulps commonly used in the manufacture of fine papers.

The wood pulp fibers useful in the present invention can also be pretreated prior to use with the present invention. This pretreatment may include physical treatment, such as subjecting the fibers to steam, or chemical treatment.

Although not to be construed as a limitation, examples of pretreating fibers include the application of fire retardants to the fibers, and surfactants or other liquids, such as water or solvents, which modify the surface chemistry of the fibers. Other pretreatments include incorporation of antimicrobials, pigments, and densification or softening agents. Fibers pretreated with other chemicals, such as thermoplastic and thermosetting resins also may be used. Combinations of pretreatments also may be employed.

In another aspect, the present invention provides cellulosic fiber sheets with retained filler particles. In one embodiment of the invention, the filler particles are positively charged. For these fibers, positively charged filler particles are bonded to the fibers through the fibers' anionic sites or through a combination of anionic and cationic retention aids. In another embodiment, the filler particles are negatively charged. For these fibers, negatively charged filler particles are bonded to the fibers through a cationic retention aid that is bonded to the fibers through the fibers' anionic sites. In a further embodiment, amphoteric particles are bonded to the fibers having fixed anionic sites through cationic and/or anionic retention aids. In a preferred embodiment, the fixed anionic sites include carboxyl groups that have been incorporated into the cellulosic fiber.

Preferably, the fiber sheets include carboxylated fibers to which have been retained ground limestone and/or clay particles through cationic polyacrylamide as the retention aid.

In another aspect of the present invention, a method for increasing the drainage rate for a papermaking machine is provided. In the method, cellulosic fibers having increased anionic sites are incorporated into a conventional papermaking furnish. By virtue of the presence of fibers having increased anionic sites in the furnish, water drainage from the furnish deposited on the forming wire of a papermachine is greatly increased compared to a similar furnish lacking fibers having retained filler particles. The fibers having increased anionic sites retain filler particles in the sheet, thereby reducing the amount of filler in the papermaking machine whitewater. Accordingly, a papermachine having its production speed limited by drainage can increase its production by incorporating fibers having increased anionic sites in accordance with the method of the invention. Similarly, a furnish including fibers having increased anionic sites allows for the incorporation of highly refined fibers with relatively low freeness to provide a sheet with increased sheet strength and that can be formed with an acceptable drainage/production rate.

The increased carboxyl content of cellulosic fibers provides the fibers with a great number of fixed anionic sites and results in increased filler capacity and retention for the fiber sheet incorporating these fibers. For paper products, sizing is increased by increasing the retention of cationic sizing emulsion particles further resulting in improved printability. With regard to sheet formation, wet end drainage from papermaking machines and machine speed can be increased by partial flocculation of the highly carboxylated fibers and fines with cationic wet end additives. Sheet strength can also be increased by enhancing the bonding of recycled furnishes with highly carboxylated fiber addition, by increasing cationic starch retention, or by increased retention of other cationic polymer dry and wet strength additives.

The following examples are for the purpose of illustrating, not limiting, the present invention.

EXAMPLES

Example 1

Comparison of Characteristics and Properties of Handsheets Prepared from Cellulosic Fibers Having Retained Filler In this example, the characteristics and properties of handsheets prepared from cellulosic fibers having increased anionic sites is compared. The handsheets were prepared from a stock mixture containing 70 percent by weight hardwood (i.e., Prince Albert hardwood pulp refined to 500 CSF in a Valley beater) and 30 percent by weight softwood. The softwood was Grand Prairie softwood pulp refined to 300 CSF. To illustrate the advantages of the present invention, handsheets were prepared from two types of softwood pulp: (1) softwood pulp as described above without further treatment and having about 3.5 milliequivalents (meq) carboxyl groups/100 g pulp (designated GP in the FIGURES) and (2) carboxyethylated softwood prepared from the above softwood and having about 23 meq carboxyl groups/100 g pulp (designated CW in the FIGURES), pulp containing cellulosic fibers having increased anionic sites.

Fine paper handsheets were formed with the following additives applied in order to a fibrous slurry (0.5 percent consistency) while stirring at 750 rpm in a Britt Jar:

(1) cationic starch added at 0.5, 1, 2, or 4 percent by weight based on the weight of total solids, followed by 1 minute of stirring;

(2) a sizing agent (ASA, alkyl succinic anhydride) added at either 2.7 or 4.0 pounds per ton fiber, followed by 15 seconds of stirring;

(3) scalenohedral precipitated calcium carbonate (sPCC) added at 25, 35, or 45 percent by weight based on the weight of total solids, followed by 15 seconds of stirring; and (4) an anionic retention aid (ACCURAC 171) added at 0.5 pounds per ton fiber, followed by 1 minute of stirring.

Sufficient stock was added to provide a sheet having a basis weight of about 75 g/m$^2$, however unretained materials caused the sheet basis weights to be lower.

The sizing of the comparative sheets was determined by the Hercules Sizing Test (HST), which measured the number of seconds that ink is held on the paper's surface before soaking in and wetting the sheet. The results for handsheets incorporating GP (3.5 meq carboxyl groups/100 g pulp) and CW (23 meq carboxyl groups/100 g pulp) having 0.5, 1, 2, and 4 percent by weight cationic starch based on the total weight of solids and either 25, 35, and 45 percent by weight filler (PCC) based on the total weight of solids is shown in FIG. 1.

Referring to FIG. 1, HST increases with decreasing filler and generally decreases with increasing cationic starch. Handsheets prepared from CW softwood generally showed significantly increased sizing, greater than about 50 percent or more, compared to GP softwood containing sheets.

Figure 2:
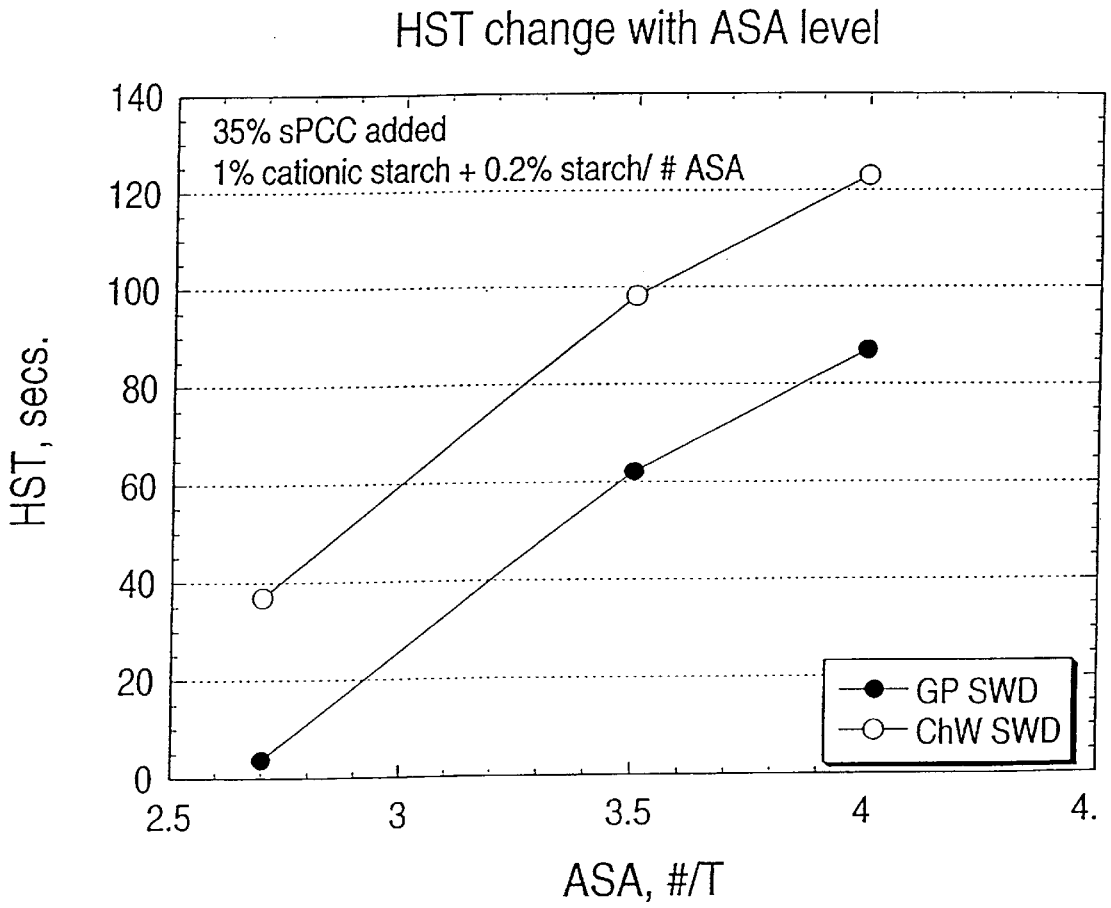
FIG. 2 is a graph illustrating change in sizing as a function of added sizing agent for fibrous sheets formed in accordance with the present invention.

Handsheet sizing as a function of sizing agent for CW- and GP-containing handsheets is illustrated in FIG. 2. Referring to FIG. 2, sizing generally increases with increasing sizing agent and handsheets prepared from CW softwood generally showed significantly increased sizing, greater than about 50 percent or more, compared to GP-containing sheets.

Figure 3:
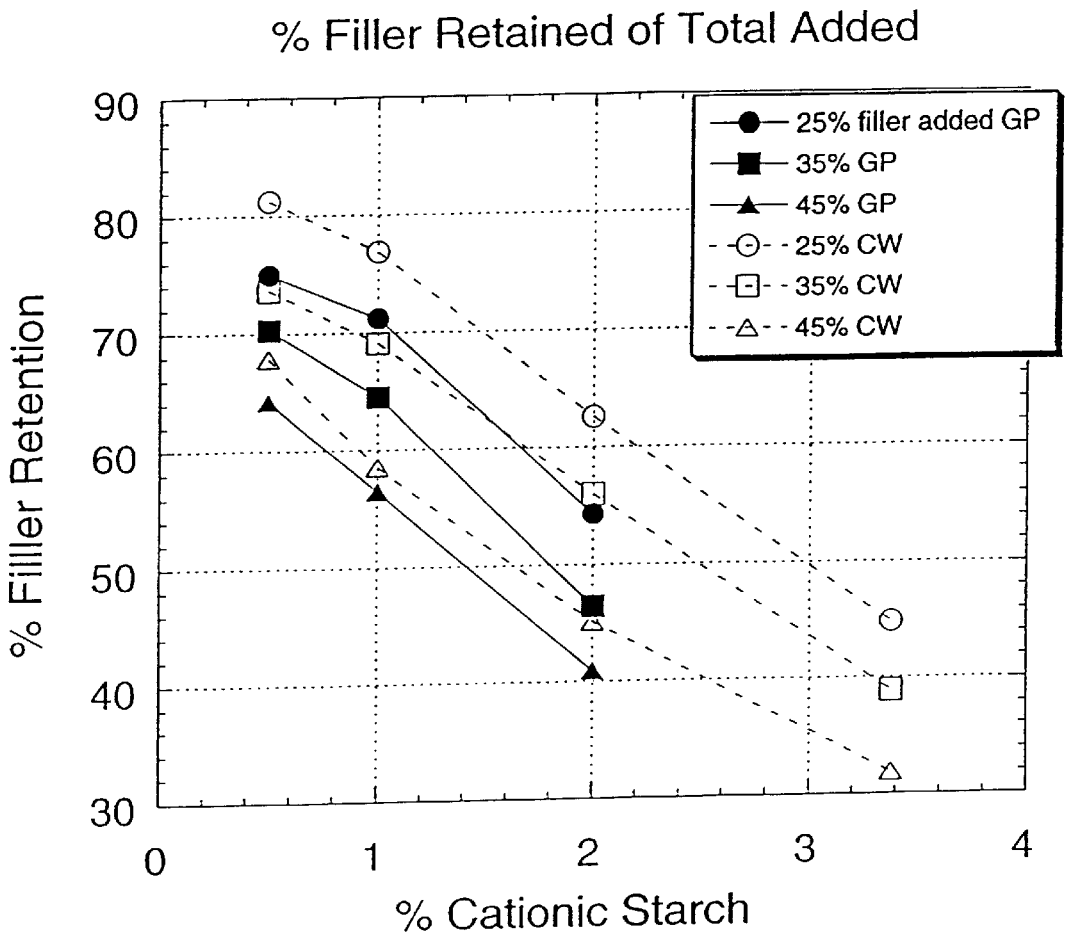
FIG. 3 is a graph illustrating percent filler retained as a function of added cationic starch for fibrous sheets formed in accordance with the present invention.

The amount of filler retained for CW- and GP-containing handsheets as a function of percent cationic starch for 25, 35, and 45 percent filler added is illustrated in FIG. 3. Referring to FIG. 3, filler retention generally decreases with increasing cationic starch and handsheets prepared from CW softwood generally showed significantly increased filler retention, greater than about 5 percent or more, compared to GP-containing sheets.

Figure 4:
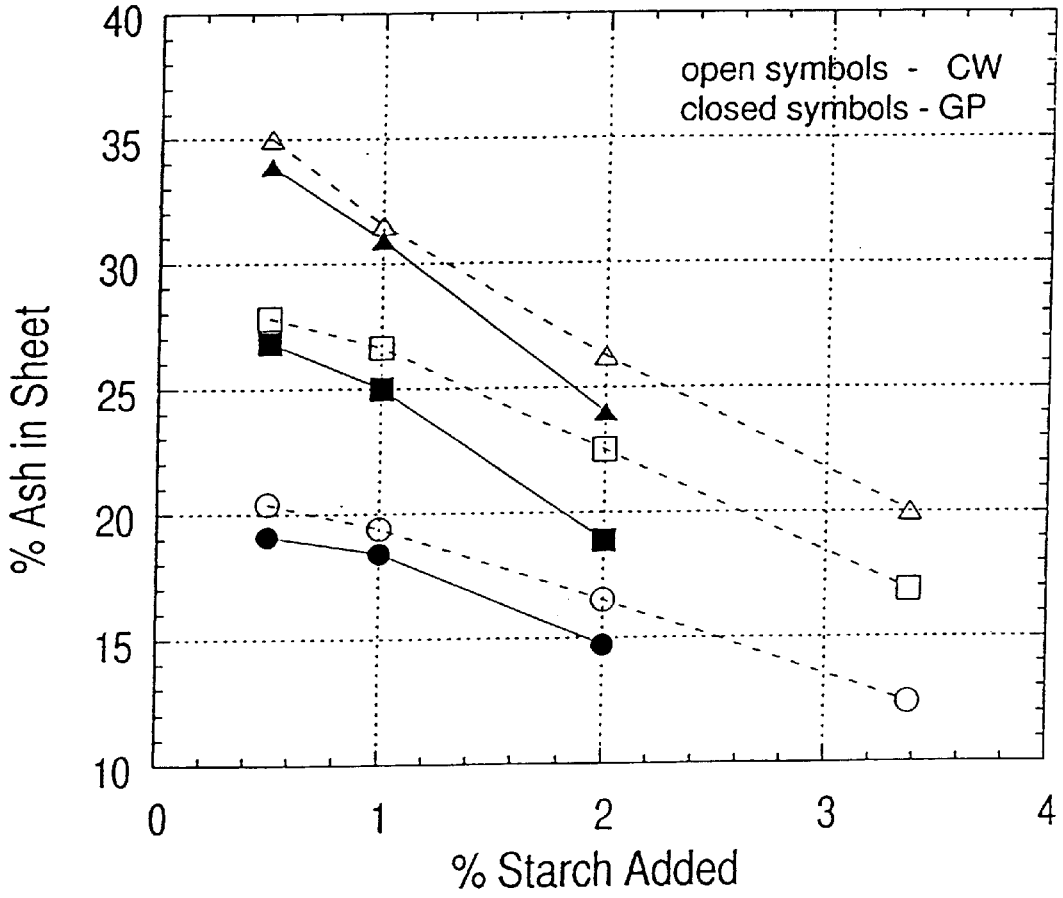
FIG. 4 is a graph illustrating percent ash in sheet as a function of added cationic starch for fibrous sheets formed in accordance with the present invention.

The amount of retained filler in a handsheet can be determined by ashing the handsheet. FIG. 4 compares the percent ash in handsheet for CW- and GP-containing handsheets as a function of percent cationic starch for 25, 35, and 45 percent filler added. Referring to FIG. 4, ash content generally decreases with increasing cationic starch and handsheets prepared from CW softwood generally showed increased ash content compared to GP-containing sheets. These results are consistent with those noted above relating to filler retention.

Figure 5:
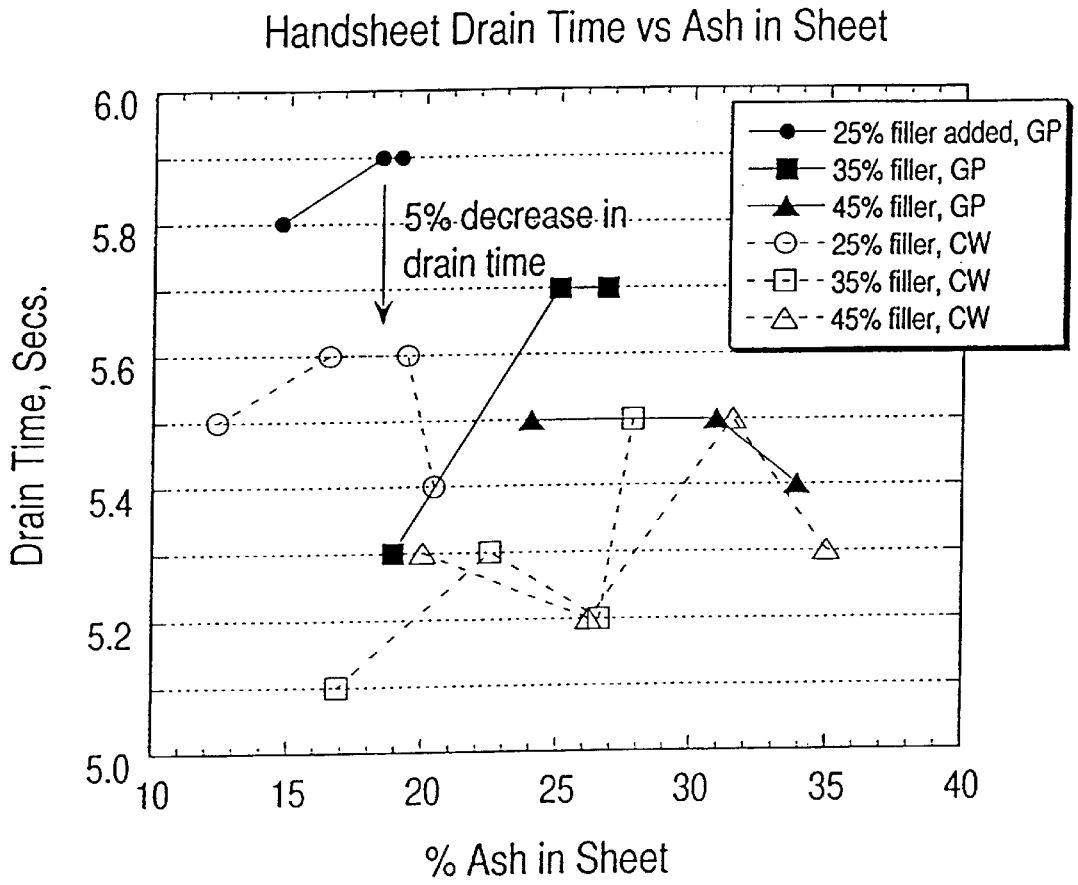
FIG. 5 is a graph illustrating drain time as a function of percent ash in sheet for fibrous sheets formed in accordance with the present invention.

Drainage time during sheet formation in a sheet mold was determined for CW- and GP-containing handsheets. Handsheet drain time as a function of ash content in the sheet was determined and the results presented in FIG. 5. As shown in FIG. 5, drain time generally decreases with increasing filler retained and handsheets containing CW softwood had significantly decreased drain times, about 5 percent, compared to the GP handsheets. The time required for drainage for sheets formed in accordance with the present invention is less than for comparable sheets that do not include such filler retained fibers.

Figure 6:
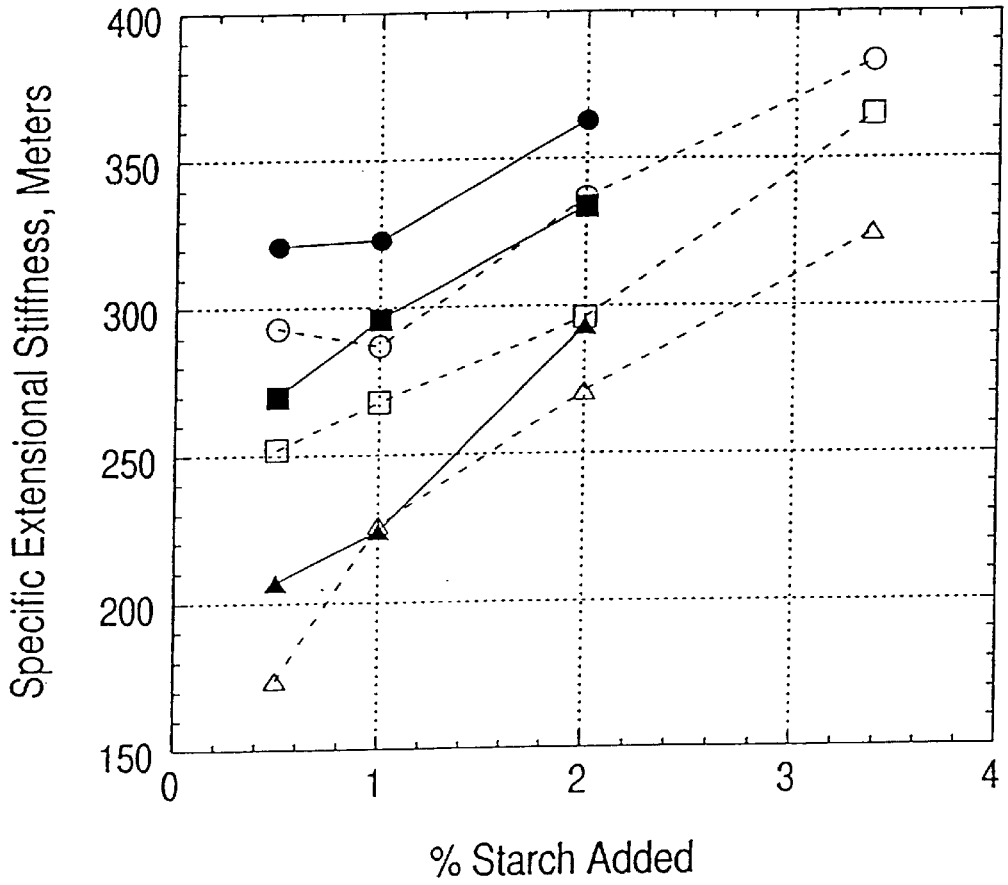
FIG. 6 is a graph illustrating specific extensional stiffness as a function of percent ash in sheet for fibrous sheets formed in accordance with the present invention.

The strength of handsheets containing CW softwood with increased retained filler was comparable to GP-containing handsheets having a lower amount of retained filler. Specific Extensional Stiffness (measured in meters) as a function of percent cationic starch for CW- and GP-containing handsheets at 25, 35, and 45 percent added filler is shown in FIG. 6. Referring to FIG. 6, stiffness generally increases with increasing starch and decreasing retained filler. The stiffness of the CW-containing sheets was slightly less but comparable to the GP-containing sheets.

Figure 7:
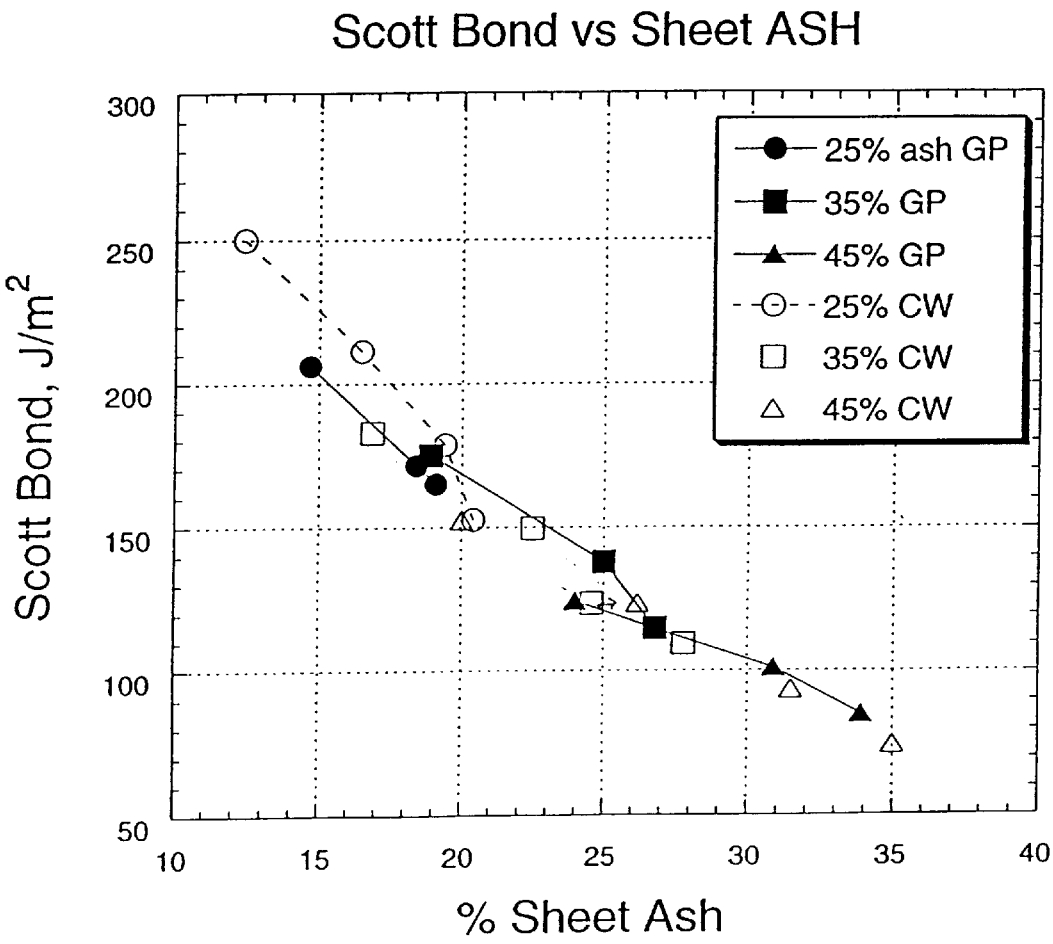
FIG. 7 is a graph illustrating sheet strength as a function of percent ash in sheet for fibrous sheets formed in accordance with the present invention.

The sheet strenth scott bond (measured in $J/M^2$) as a function of percent ash in the sheet is illustrated in FIG. 7. Referring to FIG. 7 strength generally reases with increasing ash content and increasing retained filler. The strength of handsheets containing CW softwood was greater than for GP-containing handsheets. The result indicates that improved filler distribution result in increased strength at a given ash content.

The results above demonstrate that cellulosic fiber sheets formed in accordance with the present invention exhibit advantageous properties including increased filler retention, decreased drainage times, and increased sizing compared to comparable sheets lacking fibers having increased anionic sites. Furthermore, the sheets of the invention do not suffer from a decrease in strength as a result of their increased filler retention.

Example 2

Measurement of Drainage Rate and Preparation of Low Basis Weight Low Density Tissue Handsheets In this example, the formation and drainage of a fiber furnish containing highly carboxylated fibers prepared as described in Example 4 is described.

About 30–31 g of pulp was refined in a PFI Refiner to 570±5 mL Canadian Standard Freeness. Nineteen grams (dry basis) of the refined pulp in a total of 2000 mL of water was placed in a British disintegrator, 2.28 g of 12.5% Kymene 557H solution was added, and the slurry was disintegrated for 10 minutes. The resulting disintegrated pulp slurry was diluted to 19 L to form a 0.1% consistency slurry. The drainage rate of this slurry was measured by the amount of time taken to pass 300 mL of filtrate water, using a liquid slurry head height of 36 inches, through a 1.0 inch diameter circular handsheet forming wire containing 84×76 wires per inch. The forming wire was obtained from Albany International, 435 Sixth St., Menasha, Wis., 54952.

A 12 inch×12 inch deckle box was used to form handsheets of approximately 26 $g/m^2$ basis weight and approximately 240 $kg/r^3$ density on the forming wire described above. Five sheets were formed for each pulp. The sheets were not wet pressed. Dewatering of the handsheets was accomplished by passing the sheets still on the forming wire over a vacuum slit. The sheets were dried on a steam-heated drum dryer and cured in an oven for one hour at 105° C. Wet burst strength of the sheets was measured on a Thwing Albert Model 1300-177 Wet Burst Tester manufactured by Thwing Albert Instrument Co., Philadelphia, Pa., 19154. Eight measurements were made for each pulp and the average calculated and taken as the wet burst strength.

Example 3

Wet Burst Strength and Drainage Rate of Highly Carboxylated Fibers

Pulp Sample 5C prepared as described in Example 4 was washed with 1% $CaC1_2$ solution followed by water to produce a highly carboxylated pulp with the cations substantially all calcium, and is designated Sample 5C1. Sample 5C1 was blended with Grande Prairie Softwood northern bleached kraft in a ratio of 10% Sample 5C1 and 90% northern bleached kraft. This blend was used in the evaluations described in above and was compared to a pulp consisting of 100% Grande Prairie Softwood. The pulp blend containing 10% highly carboxylated fibers showed a 17% decrease in drain time and slightly improved wet burst strength in comparison to the 100% Grande Prairie pulp at equal freeness. The results are summarized in Table 1.

TABLE 1

Drain Time and Wet Burst Comparison.

| Pulp | Drain Time (seconds) | Wet Burst (g) |
|---|---|---|
| Blend | 166 | 1152 |
| 100% Grande Prairie Softwood | 201 | 1136 |

Example 4

Preparation of Highly Carboxylated Fibers

In this example, the formation and drainage of a fiber furnish containing highly carboxylated fibers prepared as described in Example 4 is described increasing the amount of hypohalite used and/or by extending the reaction time. To illustrate this, three samples were prepared according to the following procedures. For Sample 5A, a buffer solution was prepared using 10.1 g $NaHCO_3$ and 8.48 g $Na_2CO_3$ dissolved in 2.6 L of deionized water. In this was dispersed 100 g dry basis of northern softwood kraft pulp followed by the addition of 1.4 kg ice. The pH was about 9.7. An oxidizing mixture was prepared by first mixing 200 mg TEMPO with 2.00 g NaBr then adding ~5 mnL of a total 40 mL 5.25% NaOCl solution and mixing well until the oily material was dissolved. This was added to the buffered pulp slurry. The remaining 35 mL of NaOCl solution was added slowly over the next 22 minutes. The slurry was then drained, washed, and redispersed in water with 2.13 g $NaBH_4$ to make a total weight of 1336 g. After two hours the pulp from the reducing treatment was again drained and washed. Total carboxyl content was measured as 11 meq/100 g.

For Sample 5B, 190 mL of 5.25% NaOCl solution was used and the oxidation time was 2.8 hours. during oxidation the pH dropped from 9.7 to 9.3. After washing the pulp was again slurried in water with 3.2 g $NaBH_4$ to make a total slurry weight of 2000 g. After one hour the pulp was drained and washed. Total carboxyl content was measured as 49 meq/100 g.

For Sample 5C the oxidizing mixture was made up of 427 mg TEMPO, 2.1 g NaBR and a total of 390 mL 5.25% NaOCl solution. At 2.8 hours after initiation of oxidation pH had dropped to 9.5 and 3 g $Na_2CO_3$ was added. After five hours the temperature had risen to 60° C. and pH had dropped to 9.0. At that time 250 g of ice and 4 g $Na_2CO_3$ were added. Again, at 7.5 hours after the start of oxidation an additional 4 g of $Na_2CO_3$ was added. At 8.5 hours the slurry was drained and washed. The oxidized pulp was treated with $NaBH_4$ as in Sample 5B. Total carboxyl content was 97 meq/100 g.

Water retention values are an important property of cellulose papermaking fibers. Higher values often indicate higher surface areas or relatively higher fiber saturation points. In general, higher water retention values will correlate with increased strength properties of sheeted products. Water retention as reported herein has been determined by TAPPIUM256. Briefly, a sample of known dry weight is slurried in water, centrifuged, and reweighed. Water retention values, carboxyl content, and D.P. for the three products of the present example are summarized in Table 2.

TABLE 2

Carboxyl Content, Degree of Polymerization, and Water Retention Comparison.

| Sample No. | Carboxyl meq/100 g | D.P. | Water Retention Value g/g |
|---|---|---|---|
| 5A | 11 | 1620 | 1.80 |
| 5B | 49 | 1140 | 2.55 |
| 5C | 97 | 860 | 4.21 |
| Untreated | 4 | 1700 | 1.35 |

The improvement in water retention values in all samples is immediately evident.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A method for increasing the drainage of water from a fibrous furnish deposited onto the forming wire of a papermaking machine, comprising incorporating into a fibrous furnish cellulosic fibers having increased anionic sites and positively charged filler particles, wherein the filler particles are bonded to the fibers through anionic sites incorporated into the fibers, and wherein the anionic sites comprise glucuronic acid groups.

2. A method for increasing the drainage of water from a fibrous furnish deposited onto the forming wire of a papermaking machine, comprising incorporating into a fibrous furnish cellulosic fibers having increased anionic sites and negatively charged filler particles, wherein the filler particles are bonded to the fibers through a cationic retention aid bonded to fixed anionic sites incorporated into the fibers, and wherein the anionic sites comprise glucuronic acid groups.

3. A method for increasing filler retention, sizing agent retention, and drainage of water from a fibrous furnish deposited onto the forming wire of a papermaking machine, the fibrous furnish comprising a filler and a sizing agent, comprising incorporating into the fibrous furnish cellulosic fibers having increased anionic sites and a material selected from the group consisting of positively charged filler particles, negatively charged filler particles, and a cationic material, wherein the positively charged filler particles are bonded to the fibers through the fibers' anionic sites, wherein the negatively charged filler particles are bonded to the fibers through a cationic retention aid bonded to the fibers' anionic sites, and wherein the anionic sites comprise glucuronic acid groups.

4. A method for increasing filler distribution and strength in a fibrous sheet containing a filler and ash, comprising incorporating into the fibrous furnish cellulosic fibers having increased anionic sites and a material selected from the group consisting of positively charged filler particles, negatively charged filler particles, and a cationic material, wherein the positively charged filler particles are bonded to the fibers through the fibers' anionic sites, wherein the negatively charged filler particles are bonded to the fibers through a cationic retention aid bonded to the fibers' anionic sites, and wherein the anionic sites comprise glucuronic acid groups.

5. A method for preparing a cellulosic fiber sheet having retained filler particles, comprising:

combining a cationic retention aid with negatively charged filler particles; and treating fibers having increased anionic sites with the combination of a cationic retention aid and negatively charged filler particles to provide a cellulosic fiber sheet having retained negatively charged filler particles, and wherein the anionic sites comprise glucuronic acid groups.

6. A cellulosic fiber sheet having retained filler particles, wherein the filler particles are bonded to fibers having increased anionic sites, wherein the filler particles are bonded to the fibers through the anionic sites, wherein the filler particles are selected from the group consisting of positively charged filler particles, negatively charged filler particles, and amphoteric filler particles, and wherein the anionic sites comprise glucuronic acid groups.

7. A method for preparing a cellulosic fiber sheet having retained filler particles, comprising treating fibers having increased anionic sites with positively charged filler particles to provide a cellulosic fiber sheet having retained positively charged filler particles, wherein the anionic sites comprise glucuronic acid groups.

8. The method of claim 7, wherein the positively charged filler particles comprise calcium carbonate particles.

9. A method for preparing a cellulosic fiber sheet having retained filler particles, comprising:

treating fibers having increased anionic sites with a cationic retention aid to provide cellulosic fibers having bonded cationic retention aid, wherein the anionic sites comprise glucuronic acid groups; and treating the fibers having bonded cationic retention aid with negatively charged filler particles to provide a cellulosic fiber sheet having retained negatively charged filler particles.

10. The method of claim 9, wherein the cationic retention aid is selected from the group consisting of cationic polyacrylamides and cationic starches.

11. The method of claim 9, wherein the negatively charged filler particles are selected from the group consisting of ground limestone and clay particles.

12. A cellulosic fiber sheet having retained positively charged filler particles, wherein the filler particles are bonded to the fibers through anionic sites incorporated into the fibers, and wherein the anionic sites comprise glucuronic acid groups.

13. The sheet of claim 12, wherein the positively charged filler particles comprise calcium carbonate particles.

14. A cellulosic fiber sheet having retained negatively charged filler particles, wherein the filler particles are bonded to the fibers through a cationic retention aid bonded to anionic sites incorporated into the fibers, and wherein the anionic sites comprise glucuronic acid groups.

15. The sheet of claim 14, wherein the cationic retention aid is selected from the group consisting of cationic polyacrylamides and cationic starches.

16. The sheet of claim 14, wherein the negatively charged filler particles are selected from the group consisting of ground limestone and clay particles.

17. A papermaking furnish comprising cellulosic fibers having increased anionic sites and positively charged filler particles, wherein the filler particles are bonded to the fibers through anionic sites incorporated into the fibers, and wherein the anionic sites comprise glucuronic acid groups.

18. The furnish of claim 17, wherein the positively charged filler particles comprise calcium carbonate particles.

19. A papermaking furnish comprising cellulosic fibers having increased anionic sites and negatively charged filler particles, wherein the filler particles are bonded to the fibers through a cationic retention aid bonded to anionic sites incorporated into the fibers, and wherein the anionic sites comprise glucuronic acid groups.

20. The furnish of claim 19, wherein the cationic retention aid is selected from the group consisting of cationic polyacrylamides and cationic starches.

21. The furnish of claim 19, wherein the negatively charged filler particles are selected from the group consisting of ground limestone and clay particles.

22. A method for increasing the drainage of water from a fibrous furnish deposited onto the forming wire of a papermaking machine, comprising incorporating into a fibrous furnish cellulosic fibers having increased anionic sites and a cationic material, and wherein the anionic sites comprise glucuronic acid groups.

23. The method of claim 22, wherein the cationic material comprises polyamide epichlorohydrin.

* * * * *